US005484390A

United States Patent [19]

Chiang

[11] Patent Number: 5,484,390

[45] Date of Patent: Jan. 16, 1996

[54] RECIPROCATING AND PINCHING MASSAGE DEVICE

[76] Inventor: Wang C. Chiang, 2F., No. 3, Lane 280, Chung-Chan Rd., Hsin Tien Cith, Taipei Hsien, Taiwan

[21] Appl. No.: 357,613

[22] Filed: Dec. 13, 1994

[51] Int. Cl.[6] ..... A61H 7/00

[52] U.S. Cl. ..... 601/133; 601/101

[58] Field of Search ..... 601/133, 134, 601/89, 93, 97, 101, 46

[56] References Cited

U.S. PATENT DOCUMENTS

| | | | |
|---|---|---|---|
| 2,512,536 | 6/1950 | Zadek | 601/93 |
| 3,750,655 | 8/1973 | Kolbel | 601/133 |
| 4,249,534 | 2/1981 | Muldrow | 601/133 |
| 4,920,957 | 5/1990 | Sutherland | 601/133 |
| 5,065,743 | 11/1991 | Sutherland | 601/134 |

FOREIGN PATENT DOCUMENTS

| | | | |
|---|---|---|---|
| 1438780 | 11/1988 | U.S.S.R. | 601/93 |

*Primary Examiner*—Robert A. Hafer
*Assistant Examiner*—David J. Kenealy
*Attorney, Agent, or Firm*—Pro-Techtor International

[57] ABSTRACT

A vibrating/massaging device mainly comprising an operating handle, a main body connected to the handle via a ball bearing and a steering rod, a clamp portion disposed in front of the main body and including an upper lip and a lower lip. The upper lip is pivotally connected to the lower lip and can together with the lower lip clamp a specific body. When the upper lip is driven by a driving mechanism inside the main body, it reciprocates relative to the lower lip.

1 Claim, 2 Drawing Sheets

RECIPROCATING AND PINCHING MASSAGE DEVICE

BACKGROUND OF THE INVENTION

The present invention relates to a device to vibrate and massage specific points on the human body.

The therapeutic and beneficial effects of massage are well known, however, vibrating and massaging devices are usually fairly large and difficult to transport. Because of their size, they cannot operate on a specific, small area of the body.

Accordingly, the present invention is directed to a small portable device adapted to massage a specific portion of the body.

SUMMARY OF THE INVENTION

It is therefore a primary object of the present invention to provide a device which may massage a specific part, particularly the abdomen and the waist, of a user's body.

Another object of the present invention is to provide a device which is conveniently portable for the user to massage his/her particular body area.

A further object of the present invention is to provide a device in which a safe massage driving mechanism is adopted without the risk of any side effect and bad conditions.

The device for removing superfluous fat accordingly to the present invention gently contacts and massages specific body areas by means of external force produced by simple reciprocating movement without causing any discomfort to the user.

The above and other objects of the present invention and the features and functions therefore can be best understood from the following detailed description of the preferred embodiments and the accompanying drawings:

DETAILED DESCRIPTION OF THE PREFERRED EMBODIMENTS

Figure 1:
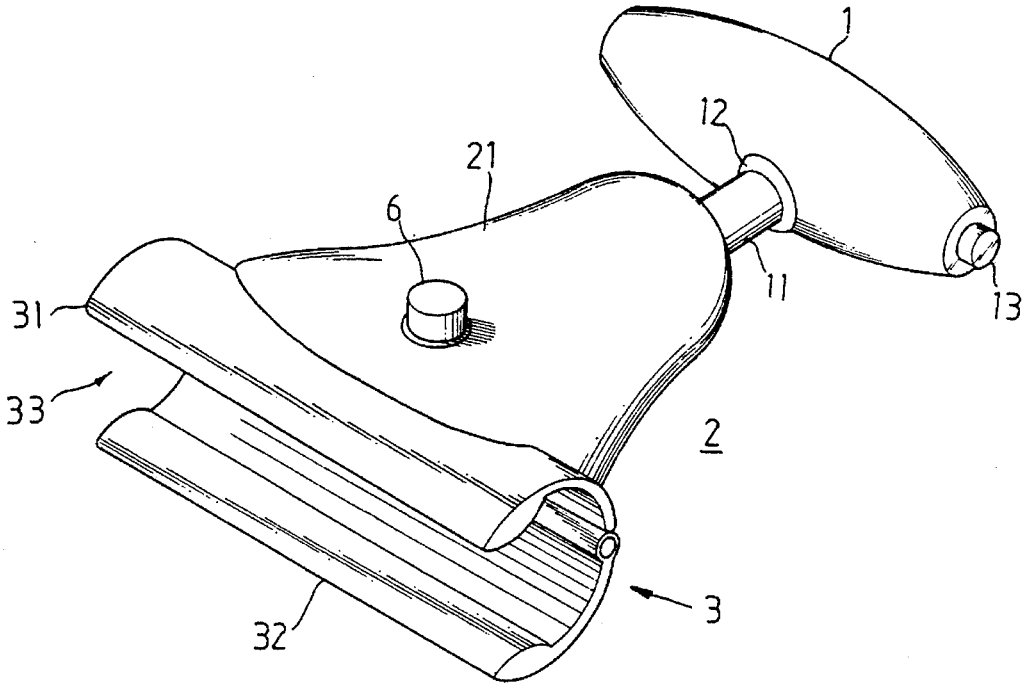
FIG. 1 is a perspective view of the vibrating/massaging device according to the present invention.
Figure 2:
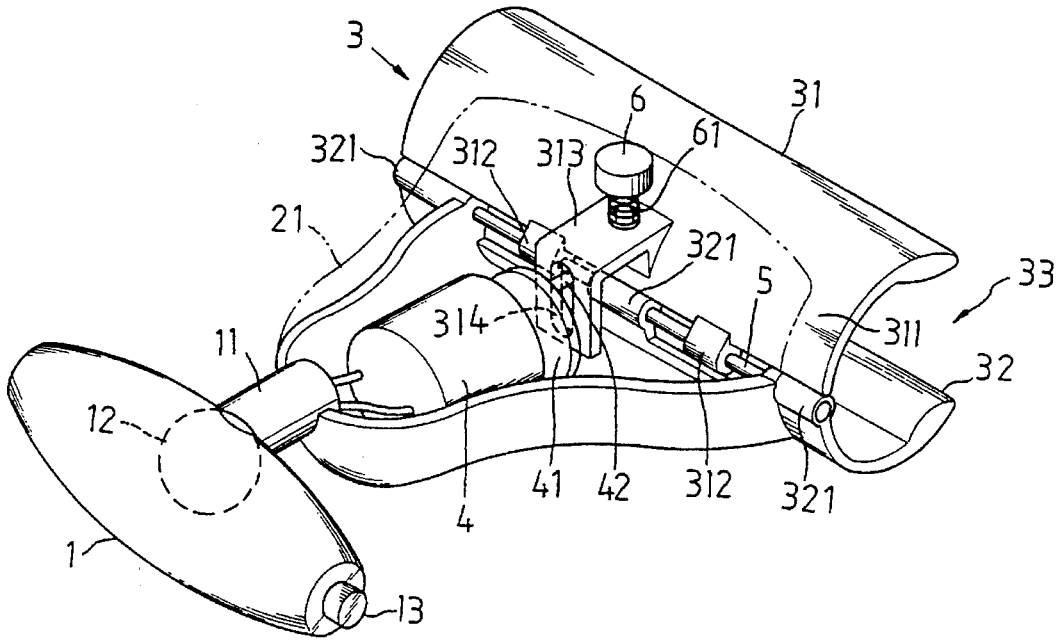
FIG. 2 illustrates the driving mechanism of the present invention.

Please refer to FIGS. 1 and 2. The present invention mainly comprises an operating handle 1, a main body 2 connected to the handle 1, and clamp portion 3 in front of the main body 2. The main body 2 is connected at its first or rear end to the operating handle 1 by means of a steering rod 11. The steering rod 11 fixedly connects at one end to the first end of the main body 2 and at the other end to the operating handle 1 via a ball bearing 12 so that the operating handle 1 may be rotated relative to the steering rod 11. The main body 2 includes an upper cover 21 and a lower seat 22. The clamp portion 3 is connected to a second or front end of the main body 2 and includes an upper lip 31 and a lower lip 32. The upper lip 31 has an inner or rear portion 311. Two shaft holders 312 are integrally formed at a rear edge of the inner portion 311 near two outer ends thereof but within two outer sides of the upper cover 21. A push plate 313 is integrally formed at a lower central portion of the inner portion 311 between the two shaft holders 312. The lower lip 32 is actually an integral part of the lower seat 22 and is disposed at and projects from a front edge of the lower seat 22 such that the lower lip 32 forms a curved projection in front of the lower seat 22. Two outer ends of the lower lip 32 laterally project from two front outer sides of the lower seat 22. Three short hollows cylinders serving as shaft holders 321 are respectively formed at two outer ends and a middle portion of the upper edge of the lower lip 32. A shaft 5 is passed through the shaft holders 312 of the upper lip 31 and the shaft holders 321 of the lower lip 32 so that the upper lip 31 is pivotally connected with the lower lip 32.

A battery-powered motor 4 is disposed in the main body 2 a rear portion thereof. The motor 4 is activated by pushing down a push-button power switch 13 provided on the operating handle 1. The operation of the motor 4 rotates a turning disk 41 on which an eccentric driving rod 42 is provided. The driving rod 42 extends into a vertical slot 314 formed on the downward extension of the push plate 313 of the upper lip 31. The rotation of the turning disk 41 causes the eccentric driving rod 42 to move the push plate 313 and accordingly the upper lip 31 along the shaft 5 side to side in a reciprocating movement. The reciprocating movement of the upper lip 31 relative to the fixed lower lip 32 causes a side to side vibration on the body area being clamped by the device.

A compression spring 61 and an adjusting knob 6 are provided on a top portion of the push plate 313. The head of the adjusting knob 6 projects out of a top surface of the upper cover 21. When the adjusting knob 6 is conveniently turned from outside the upper cover 21, the upper lip 31 is pressed down or is raised relative to the lower lip 32 and thereby changes the span of opening 33 between the upper and the lower lips 31, 32.

Figure 3:
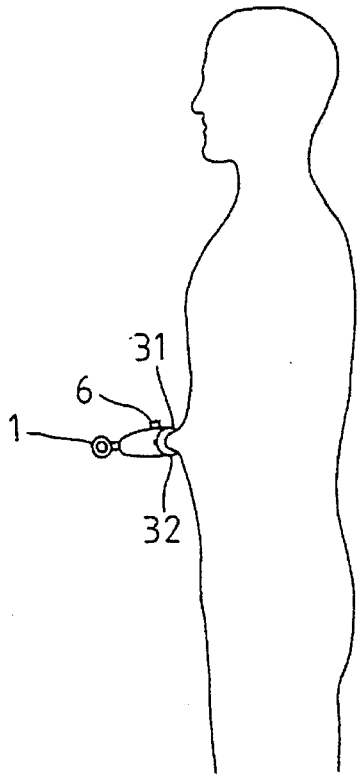
FIG. 3 illustrates the present invention being used to clamp and vibrate a specific part of the user's abdomen.
Figure 4:
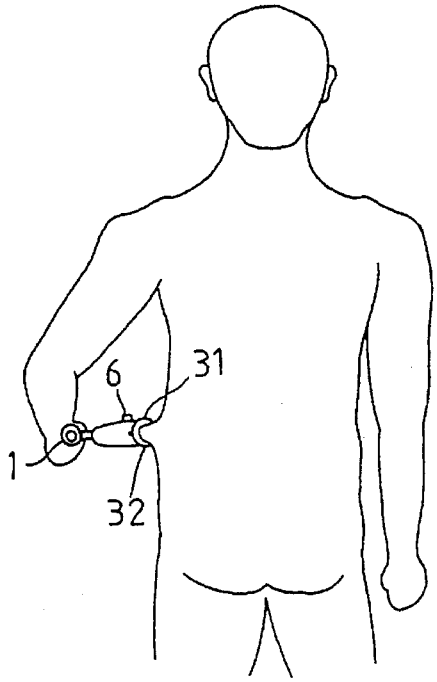
FIG. 4 illustrates the present invention being used to clamp and vibrate a specific part of the user's waist.

Please refer to FIGS. 3 and 4. The device according to the present invention can be used to securely clamp the superfluous fat at the user's abdomen or waist by means of its upper and lower lips 31, 32. The opening between lips 31 and 32 can be conveniently adjusted by turning the adjusting knob 6 which projects from the upper cover 21 of the device. Since the upper and the lower lips 31, 32 are made of soft, resilient, and flexible rubber material, they will not hurt the skin when the lips frictionally contact with and massage the skin. To operate the device, hold the operating handle 1 and allow it to turn on the ball bearing 12 so that the handle 1 may be comfortably held at a suitable angle relative to the main body 2. Then, turn on the power switch 13 on the handle 1, causing the upper lip 31 to reciprocate or vibrate along the shaft 5 above the lower lip 32. By means of such vibration, the body area having superfluous fat and being clamped by the two lips of the device can be properly rubbed and massaged.

What is claimed is:

1. A vibrating/massaging device comprising:

an operating handle, a main body connected to said operating handle via a ball bearing and a steering rod disposed between said operating handle and said main body, and a clamp portion disposed in front of said main body;

said main body comprises an upper cover and a lower seat, said clamp portion comprises an upper lip and a lower lip, said upper lip having an inner portion which is integrally provided at a rear edge adjacent to said main body with two side shaft holders and a middle push plate, said lower lip being an integral part of said lower seat and extending forward from said lower seat with two lateral ends of said lower lip laterally projecting beyond two sides of said lower seat, said lower lip further including at two outer ends and a middle point three hollow cylindrical shaft holders integral to said lower lip, said upper lip being pivotally connected to said lower lip by means of a shaft passing through said two side shaft holders of said upper lip and said three shaft holders of said lower lip, said push plate having a downward extension on which a vertical slot is formed through which a driving rod eccentrically disposed on a turning disc extends, said turning disc being driven by a battery-powered motor disposed inside said main body, said motor being actuated by means of a push-button power switch provided on said operating handle; wherein when said motor is actuated; said turning disk rotates, thereby driving said eccentric driving rod against said push plate and accordingly causing said upper lip to reciprocate along said shaft side to side relative to said lower lip, said push plate including at a top side an adjusting knob and a compression spring disposed between said adjusting knob and said push plate below said upper cover such that the size of an opening defined by said upper lip and said lower lip can be adjusted by turning said adjusting knob.

* * * * *